US010602285B2

(12) United States Patent
Bryant et al.

(10) Patent No.: US 10,602,285 B2
(45) **Date of Patent: *Mar. 24, 2020**

(54) SYSTEM AND METHOD FOR AUTOMATED HEARING AID PROFILE UPDATE

(71) Applicant: III Holdings 4, LLC, Wilmington, DE (US)

(72) Inventors: Gregory Allen Bryant, Georgetown, TX (US); Frederick Charles Neumeyer, Austin, TX (US); Gregory Charles Yancey, Austin, TX (US)

(73) Assignee: III Holdings 4, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/054,981

(22) Filed: Aug. 3, 2018

(65) Prior Publication Data

US 2019/0052982 A1 Feb. 14, 2019

Related U.S. Application Data

(63) Continuation of application No. 14/611,944, filed on Feb. 2, 2015, now Pat. No. 10,045,131, which is a continuation of application No. 13/723,667, filed on Dec. 21, 2012, now Pat. No. 8,965,017.

(60) Provisional application No. 61/583,921, filed on Jan. 6, 2012.

(51) Int. Cl.
*H04R 25/00* (2006.01)

(52) U.S. Cl.
CPC ..... *H04R 25/70* (2013.01); *H04R 25/55* (2013.01); *H04R 25/554* (2013.01); *H04R 2225/55* (2013.01)

(58) Field of Classification Search
CPC .... H04R 25/70; H04R 2225/55; H04R 25/50; H04R 25/505; H04R 2225/41; H04R 2460/03; H04R 2460/07; H04R 25/30; H04R 25/55; H04R 25/554; H04R 25/558; G06F 8/65
USPC ..... 381/312, 314–315, 317, 23.1, 74, 41.2, 381/41.3, 60
See application file for complete search history.

(56) References Cited

U.S. PATENT DOCUMENTS 4,759,070 A 7/1988 Voroba et al.
4,947,432 A 8/1990 Topholm
4,972,487 A 11/1990 Mangold et al.
5,721,783 A 2/1998 Anderson
(Continued)

FOREIGN PATENT DOCUMENTS

WO 2009001559 A1 12/2008
WO 2008071236 A2 6/2018

OTHER PUBLICATIONS

Kasoff, B. "A Closer Look: The Evolution of the Smart Phone." Women Impacting Public Policy. Sep. 19, 2014, 3 pages. Exhibit 1016, IPR2017-00783.

(Continued)

*Primary Examiner* — Norman Yu
(74) *Attorney, Agent, or Firm* — Brinks Gilson & Lione

(57) ABSTRACT

A method includes receiving a new hearing aid profile generating instruction, generating a new hearing aid profile corresponding to each of a plurality of hearing aid users in response to receiving the new hearing aid profile, and providing the new hearing aid profile to a computing device associated with the hearing aid users.

16 Claims, 4 Drawing Sheets

(56) References Cited

U.S. PATENT DOCUMENTS

| | | | |
|---|---|---|---|
| 5,785,661 | A | 7/1998 | Shennib |
| 6,741,712 | B2 | 5/2004 | Bisgaard et al. |
| 7,200,237 | B2 | 4/2007 | Zhang et al. |
| 7,519,194 | B2 | 4/2009 | Niederdränk et al. |
| 7,933,419 | B2 | 4/2011 | Roeck et al. |
| 8,077,891 | B2 | 12/2011 | Hasler et al. |
| 8,280,369 | B1 | 10/2012 | Reeves et al. |
| 8,379,871 | B2 | 2/2013 | Michael et al. |
| 8,406,442 | B2 | 3/2013 | Ribic et al. |
| 8,457,335 | B2 | 6/2013 | Imamura et al. |
| 8,526,649 | B2 | 9/2013 | Foo et al. |
| 8,588,442 | B2 | 11/2013 | Schmitt et al. |
| 8,611,570 | B2 | 12/2013 | Neumeyer et al. |
| 8,649,538 | B2 | 2/2014 | Apfel et al. |
| 8,654,999 | B2 | 2/2014 | Mindlin, II et al. |
| 8,761,421 | B2 | 6/2014 | Apfel et al. |
| 8,787,603 | B2 | 7/2014 | Fichtl et al. |
| 8,810,392 | B1 | 8/2014 | Teller et al. |
| 8,965,017 | B2 | 2/2015 | Bryant et al. |
| 9,191,756 | B2 | 11/2015 | Neumeyer et al. |
| 9,479,876 | B2 | 10/2016 | Neumeyer |
| 10,045,131 | B2 | 8/2018 | Bryant et al. |
| 10,111,018 | B2 | 10/2018 | Neumeyer |
| 2003/0008659 | A1 | 1/2003 | Waters et al. |
| 2003/0059076 | A1 | 3/2003 | Martin et al. |
| 2003/0215105 | A1 | 11/2003 | Sacha et al. |
| 2004/0059446 | A1 | 3/2004 | Goldberg et al. |
| 2005/0036637 | A1 | 2/2005 | Janssen et al. |
| 2006/0182294 | A1 | 8/2006 | Grasbon et al. |
| 2007/0098195 | A1 | 5/2007 | Holmes et al. |
| 2007/0255435 | A1 | 11/2007 | Cohen et al. |
| 2009/0047994 | A1 | 2/2009 | Sommer et al. |
| 2009/0154741 | A1 | 6/2009 | Woods et al. |
| 2010/0027822 | A1 | 2/2010 | Dietz |
| 2010/0255782 | A1 | 10/2010 | Klemmensen |
| 2010/0273452 | A1 | 10/2010 | Rajann et al. |
| 2010/0290654 | A1 | 11/2010 | Wiggins et al. |
| 2011/0176697 | A1* | 7/2011 | Apfel ..... H04R 25/305 381/314 |
| 2012/0183165 | A1* | 7/2012 | Foo ..... H04R 25/50 381/314 |
| 2012/0213390 | A1 | 8/2012 | Foo et al. |
| 2012/0219159 | A1 | 8/2012 | Burk et al. |
| 2012/0237064 | A1 | 9/2012 | Garratt et al. |
| 2013/0266165 | A1 | 10/2013 | Neumeyer et al. |
| 2015/0156596 | A1 | 6/2015 | Bryant et al. |
| 2017/0142530 | A1 | 5/2017 | Neumeyer |
| 2019/0124456 | A1 | 4/2019 | Neumeyer |

OTHER PUBLICATIONS

"Good Practice Guidance for Adult Hearing Aid Fittings and Services," prepared for International Society of Audiology, Nov. 2004, 8 pages, Exhibit 1012, Case IPR2017-00781.

American Heritage Dictionary of the English Language, 5th edition, 2011, p. 1652. Exhibit 1011. Case IPR2017-00783.

Aug. 16, 2013 Response dated Jun, 4, 2013 Office Action in Prosecution History of U.S. Pat. No. 8,611,570, 9 pages, Exhibit 1004, Case IPR2017-00367.

Barron's Dictionary of Computer and Internet Terms, 11th edition, 2013, p. 457. Exhibit 1012, Case IPR2017-00783.

Certified English language translation of German Patent Publication No. DE19542961, May 15, 1997, 16 pages. Exhibit 1009, Case IPR2017-00781.

Certified English language translation of WIPO Patent Publication No. WO2009/001559 to Imamura et al., Dec. 31, 2008, 79 pages. Exhibit 1006, Case IPR2017-00367.

Consumer Reports, "Hear Well in a Noisy World, Hearing aids Features at a glance," Jul. 2009, 2 pages. Exhibit 1009, Case IPR2017-00414.

Declaration of Dr. Les Atlas, Exhibit 1008, Case IPR2017-00781, Jan. 26, 2017, 145 pages.

Declaration of Dr. Robert E. Morley, Jr., Exhibit 1002, Case IPR2017-00496. Dec. 21, 2016, 87 pages.

Declaration of Dr. Robert K. Morrow, Exhibit 1003, Case IPR2017-00783, Jan. 27, 2017, 85 pages. Exhibit 1003, Case IPR2017-00783.

Declaration of Dr. Sayfe Kiaei, Exhibit 1002, Case IPR2017-00367. Dec. 4, 2016, 102 pages.

Declaration of Les Atlas PhD, Exhibit 1003, Case IPR2017-00414. Dec. 6, 2016, 111 pages.

Dillon et al., "The trainable hearing aid: What will it do for clients and clinicians?" The Hearing Journal, vol. 59, No. 4, Apr. 2006, 6 pages. Exhibit 1014, Case IPR2017-00781.

Jul. 10, 2013 Response dated May 30, 2013 Office Action in Prosecution History of U.S. Pat. No. 8,761,421, 13 pages. Exhibit 1008, Case IPR2017-00496.

Keidser, Gitte et al., "Variation in preferred gain with experience for hearing-aid users," 2008, International Journal of Audiology 47:10, 621-635. Exhibit 1013, Case IPR2017-00781.

Mar. 1, 2013 Response dated Dec. 12, 2012 Office Action in Prosecution History of U.S. Pat. No. 8,761,421, 22 pages. Exhibit 1006, Case IPR2017-00496.

Martin, T., "The evolution of the smartphone," Jul. 28, 2014, 40 pages. <pocketnow.com/2014/07/28/the-evolution-of-the-smartphone> Exhibit 1014, Case IPR2017-00783.

Mukherjee, S., "Smartphone Evolution: From IBM Simon to Samsung Galaxy S3," May 8, 2012, p. 3. <ibtimes.com/smartphone-evolution-ibm-simon-samsung-galaxy-s3-697340> Exhibit 1015, Case IPR2017-00783.

Prosecution History of U.S. Pat. No. 8,649,538 to Apfel et al., 166 pages; patent application filed Feb. 8, 2011. Exhibit 1002, Case IPR2017-00414.

Prosecution History of U.S. Pat. No. 8,654,999 to Mindlin et al., 194 pages; patent application filed Apr. 12, 2011. Exhibit 1002, Case IPR2017-00781.

Prosecution History of U.S. Pat. No. 9,191,756 to Neumeyer et al., 71 pages; patent application filed Dec. 7, 2012. Exhibit 1002, Case IPR2017-00783.

Rodriguez, Gary P. et al. "Preferred Hearing Aid Response Characteristics Under Acoustic and Telecoil Coupling Conditions," American Journal of Audiology, Nov. 1993, pp. 55-59. Exhibit 1011, Case IPR2017-00414.

Sager, I., "Before IPhone and Android Came Simon, the First Smartphone," Jun. 29, 2012, 9 pages. <bloomberg.com/news/articles/2012-06-29/before-iphone-and-android-came-simon-the-first-smartphone> Exhibit 1013, Case IPR2017-00783.

United States Patent and Trademark Office, Dec. 12, 2012 Office Action from Prosecution History of U.S. Pat. No. 8,761,421, 19 pages. Exhibit 1003, Case IPR2017-00496.

United States Patent and Trademark Office, Final Office Action, U.S. Appl. No. 13/782,710, dated Dec. 2, 2015, 15 pages.

United States Patent and Trademark Office, Final Office Action, U.S. Appl. No. 13/782,710, dated Oct. 23, 2014, 16 pages.

United States Patent and Trademark Office, Final Office Action, U.S. Appl. No. 14/611,944, dated Nov. 4, 2016, 21 pages.

United States Patent and Trademark Office, Final Office Action, U.S. Appl. No. 15/268,470, dated Oct. 18, 2017, 21 pages.

United States Patent and Trademark Office, Jun. 4, 2013 Office Action from Prosecution History of U.S. Pat. No. 8,611,570, 6 pages, Exhibit 1003, Case IPR2017-00367.

United States Patent and Trademark Office, May 30, 2013 Office Action from Prosecution History of U.S. Pat. No. 8,761,421, 19 pages. Exhibit 1007, Case IPR2017-00496.

United States Patent and Trademark Office, Non Final Office Action, U.S. Appl. No. 13/723,667, dated Mar. 13, 2014, 14 pages.

United States Patent and Trademark Office, Non-Final Office Action, U.S. Appl. No. 13/782,710, dated Apr. 11, 2014, 19 pages.

United States Patent and Trademark Office, Non-Final Office Action, U.S. Appl. No. 13/782,710, dated Mar. 2, 2015, 14 pages.

United States Patent and Trademark Office, Non-Final Office Action, U.S. Appl. No. 14/611,944, dated May 17, 2016, 19 pages.

United States Patent and Trademark Office, Non-Final Office Action, U.S. Appl. No. 14/611,944, dated Sep. 11, 2017, 16 pages.

United States Patent and Trademark Office, Non-Final Office Action, U.S. Appl. No. 15/268,470, dated Apr. 6, 2017, 14 pages.

(56) References Cited

OTHER PUBLICATIONS

United States Patent and Trademark Office, Non-Final Office Action, U.S. Appl. No. 15/268,470, dated Mar. 5, 2018, 18 pages.
United States Patent and Trademark Office, Notice of Allowance, U.S. Appl. No. 13/723,667, dated Oct. 17, 2014, 7 pages.
United States Patent and Trademark Office, Notice of Allowance, U.S. Appl. No. 13/782,710, dated Jun. 15, 2016, 10 pages.
United States Patent and Trademark Office, Notice of Allowance, U.S. Appl. No. 14/611,944, dated Apr. 6, 2018, 16 pages.
United States Patent and Trademark Office, Notice of Allowance, U.S. Appl. No. 15/268,470, dated Jul, 20, 2018, 6 pages.
United States Patent and Trademark Office, Patent Trial and Appeal Board, *K/S HIMPP* v. *III Holdings 4, LLC*, Case IPR2017-00367 (U.S. Pat. No. 8,611,570), Petition for Inter Partes Review, Dec. 6, 2016, 81 pages.
United States Patent and Trademark Office, Patent Trial and Appeal Board, *K/S HIMPP* v. *III Holdings 4, LLC*, Case IPR2017-00414 (U.S. Pat. No. 8,649,538), Petition for Inter Partes Review, Dec. 6, 2016, 84 pages.
United States Patent and Trademark Office, Patent Trial and Appeal Board, *K/S HIMPP* v. *III Holdings 4, LLC*, Case IPR2017-00496 (U.S. Pat. No. 8,761,421), Petition for Inter Partes Review, Dec. 21, 2016, 91 pages.
United States Patent and Trademark Office, Patent Trial and Appeal Board, *K/S HIMPP* v. *III Holdings 4, LLC*, Case IPR2017-00781 (U.S. Pat. No. 8,654,999), Petition for Inter Partes Review of claims 1-9 and 16-19, Jan. 27, 2017, 69 pages.
United States Patent and Trademark Office, Patent Trial and Appeal Board, *K/S HIMPP* v. *III Holdings 4, LLC*, Case IPR2017-00782 (U.S. Pat. No. 8,654,999), Petition for Inter Partes Review of claims 10-15 and 20, Jan. 27, 2017, 56 pages.
United States Patent and Trademark Office, Patent Trial and Appeal Board, *K/S HIMPP* v. *III Holdings 4, LLC*, Case IPR2017-00783 (U.S. Pat. No. 9,191,756), Petition for Inter Partes Review, Jan. 27, 2017, 79 pages.
Valente, Michael, "Guideline for Audiologic Management of the Adult Patient," Audiology Online 2016, Oct. 30, 2006, 8 pages. Exhibit 1011, Case IPR2017-00781.
Widrow, B. et al. "Microphone arrays for hearing aids: An overview," Elsevier Science B.V. Speech Communication 39 (2003), pp. 139-146. Exhibit 1010, Case IPR2017-00414.
United States Patent and Trademark Office, Non-Final Office Action, U.S. Appl. No. 16/167,348, dated Feb. 27, 2019, 17 pages.
United States Patent and Trademark Office, Non-Final Office Action, U.S. Appl. No. 16/167,348, dated May 1, 2019, 14 pages.

* cited by examiner

SYSTEM AND METHOD FOR AUTOMATED HEARING AID PROFILE UPDATE

CROSS-REFERENCE TO RELATED APPLICATION(S)

This application is a continuation of U.S. patent application Ser. No. 14/611,944, filed on Feb. 2, 2015, now U.S. Pat. No. 10,045,131, which is a continuation of U.S. patent application Ser. No. 13/723,667, filed on Dec. 21, 2012, now U.S. Pat. No. 8,965,017 and entitled, "SYSTEM AND METHOD AUTOMATED HEARING AID PROFILE UPDATE", which claims priority to U.S. Provisional Patent Application No. 61/583,921, filed on Jan. 6, 2012 and entitled "SYSTEM AND METHOD AUTOMATED HEARING AID PROFILE UPDATE", all of which are incorporated herein by reference in their entireties.

FIELD

This disclosure relates generally to system and methods of updating the settings of a hearing aid.

BACKGROUND

Hearing deficiencies can range from partial to complete hearing loss. Often, an individual's hearing ability varies across the range of audible sound frequencies, and many individuals have hearing impairments with respect to only select acoustic frequencies. For example, an individual's hearing loss may be greater at higher frequencies than at lower frequencies, or vice versa.

Hearing aids have been developed to alleviate the effects of hearing losses in individuals. Conventionally, hearing aids are configurable to amplify or otherwise modulate sounds to compensate for the particular hearing impairment of a patient. Each hearing aid is tuned by a hearing health professional to compensate for the unique variations of the individual's hearing loss in each ear.

Typically, a hearing health professional takes measurements using calibrated and specialized equipment to assess an individual's hearing capabilities in a variety of sound environments, and then adjusts the hearing aid parameters based on the calibrated measurements and a hearing profile generating algorithm typically provided by the manufacture. In some instances, the hearing health professional may create multiple hearing aid profiles by adjusting the hearing aid parameters differently for use in different sound environments or by applying different algorithms. Such hearing profiles include frequency and amplitude adjustments that can be applied to sound-related signals to compensate for a particular user's hearing deficiencies and to filter frequencies or reduce the volume in certain acoustic environments.

Unfortunately, from time-to-time the hearing aid settings may need to be adjusted, which typically requires the user to revisit the hearing health professional. Further occasionally, new algorithms may be published and old algorithms are updated. For the user to take advantage of such advances, the user will need to purchase new hearing aids or revisit the hearing health professional.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of a system and methods for automated adjustment of hearing aid profiles are described below. In an example, a computing device includes a transceiver configured to communicate wirelessly with a hearing aid and to provide data to the hearing aid, such as an updated or new hearing aid profile. As used herein, the term "hearing aid profile" refers to a collection of parameters and coefficients that can be applied by a processor of the hearing aid to process sounds to produce a modulated output signal that compensates for the user's hearing impairment. The computing device is also configurable to communicate with a profile generating system through a network. The profile generating system is configured to generate updates and new hearing aid profiles in response to changes in hearing aid profile generating instructions or algorithms.

In an example, a new profile generating instructions is developed by hearing health professionals and is added to the profile generating system. The profile generating system is able to generate a new unique hearing aid profile based on the added profile generating instructions and the user's hearing loss profile. In one instance, the profile generating system establishes a communication link with a computing device associated with each of the users through a network and provides the unique hearing aid profile to the computing device. The profile generating system continues to provide profiles to each of the users until each user receives the new hearing aid profile. In another instance, the profile generating system establishes a communication link with a computing device associated with each of the users through a network and provides an alert to each of the computing devices indicating that a new hearing aid profile is available.

Figure 1:
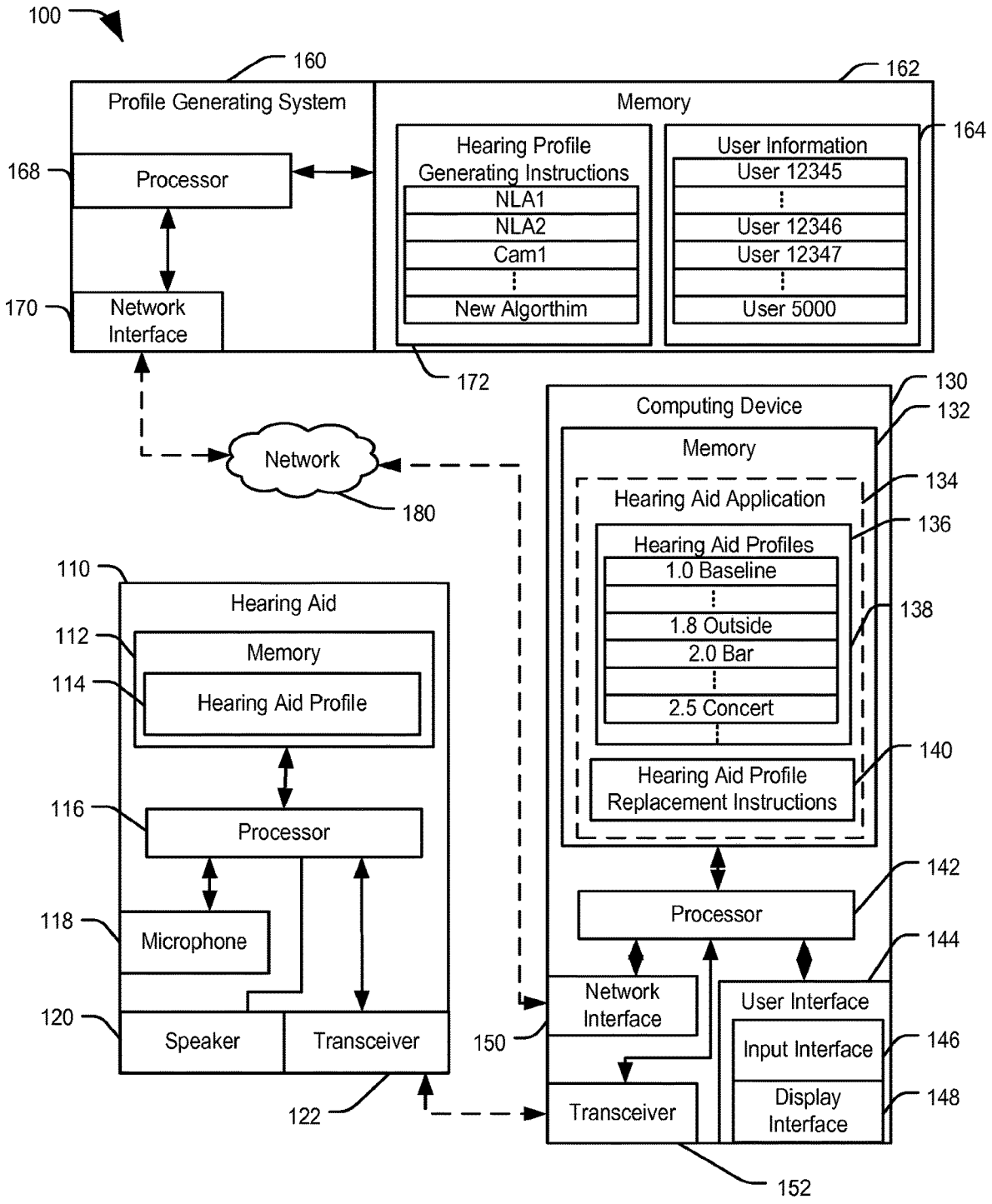
FIG. 1 is a block diagram of an embodiment of a system including a hearing aid, a computing device, and a profile generating system adapted to provide automated hearing aid profile updates.

FIG. 1 is a block diagram of an embodiment of a system 100 including a hearing aid 110, a computing device 130, and a profile generating system 160 adapted to provide automated hearing aid profile updates. Hearing aid 110 includes a memory 112 which is configured to store at least one hearing aid profile 114, a microphone 118, and a speaker 120. Hearing aid 110 further includes a processor 116 coupled to memory 112, microphone 118, and speaker 120 and configured to process an audio signal provided by microphone 118 according hearing aid profile 114 to produce a modulated audio signal, which is reproduced by speaker 120. Hearing aid 110 also includes a transceiver 122 configured to communicate with computing device 130.

Computing device 130 includes transceiver 152 configured to communicate with transceiver 122 of hearing aid 110 and a network interface 150 configured to communicate through network 180 with profile generating system 160. Computing device 130 also includes a user interface 144 including an input interface 146 and a display interface 148. In some instances, user interface 144 may be a touch screen interface such that input interface 146 and display interface 148 are combined. Computing device 130 also includes a memory 132 configured to store a hearing aid application 134 which includes one or more hearing aid profiles 136 and a hearing aid profile replacement instruction 140. User interface 144, network interface 150, transceiver 152, and memory 132 are coupled to processor 142, such that processor 142 can execute instructions and hearing aid application 134 stored in memory 132.

Computing device 122 may be a cell phone, tablet, notebook computer, or other portable computing device. One representative embodiment of computing device 122 is the Apple iPhone®, which is commercially available from Apple, Inc. of Cupertino, Calif. Another representative embodiment of computing device 122 is the Blackberry®, available from Research In Motion Limited of Waterloo, Ontario. Other types of mobile computing devices can also be used, such as a device utilizing the Android® operating system.

Profile generating system 160 includes a network interface 170 configured to communicate through network 180 to a plurality of computing devices, such as computing device 130. Profile generating system 160 further includes a processor 168 coupled to memory 162 and to network interface 170. Processor 168 is configured to access a plurality of hearing profile generating instructions 172 and a plurality of user information 164 stored in memory 162. The user information 164 includes at least a hearing loss profile associated with the user and a computing device identifier to identify a computing device associated with a user, such as computing device 130. Profile generating system 160 may be a server or customer service data system configured to provide automated hearing aid updates.

Plurality of user information 164 may include a user identifier, a hearing loss profile, one or more hearing aid profiles, user's hearing aid make and model, and/or other user information. Hearing profile generating instructions 172 includes a plurality of algorithms and instructions. Each of the algorithms and instructions when executed by processor 168 cause processor 168 to generate a hearing aid profile from a user's hearing loss profile that is customized for the individual user's hearing loss. Examples of common algorithms and instructions for generating hearing aid profiles include NLA1, NLA2, and CAM1.

In operation, a new hearing profile generating instruction is added to the plurality of hearing profile generating instructions 172 stored in memory 162 of profile generating system 160. In one embodiment, processor 168 is configured to detect when a new hearing profile generating instruction is added to memory 162 or when one of the plurality of hearing profile generating instructions 172 are altered. When processor 168 detects the new hearing profile generating instructions, profile generating system 160 may generate a hearing aid profile according to the new hearing aid profile instructions and the hearing loss profile stored in user information 164.

In one example, processor 168 may cycle through user information 164 for each hearing aid user and generates a hearing aid profile for each user and stores the new hearing aid profile with user information 164. Once a hearing aid profile is generated for a particular user, processor 168 communicates with computing device 130 through network 180. In one instance, processor 168 pushes the hearing aid profile to computing device 130, which adds the hearing aid profile to the plurality of hearing aid profiles 136. In another instance, processor 168 sends an alert from network interface 170 to network interface 150 in computing device 130 indicating that there is a hearing aid profile ready for download.

In another example, profile generating system 160 may provide alerts to computing device 130. In this example, computing device 130 receives the alert and provides the alert to the user via the display interface 148. The user is then able to opt in to the hearing aid profile update using input interface 146. When the user opts in to the hearing aid profile update, computing device 130 requests the update from profile generating system 160. In response to receiving the request, processor 168 generates a hearing aid profile using the updated or new hearing profile generating instruction and profile generating system 160 provides the hearing aid profile to computing device 130.

In the first instance, when a user activates hearing aid application 134, processor 142 of computing device 130 detects the hearing aid profile and provides a notification to user interface 144 alerting the user that the hearing aid profile has been added to hearing aid application 134. In the second instance, when the user activates hearing aid application 134, processor 142 of computing device 130 receives the alert and provides a notification to user interface 144 alerting the user that the hearing aid profile is ready for download. In one embodiment, hearing aid application 134 may be active in the background of computing device 130 and, when the alert is received by processor 142, processor 142 provides the notification to the user. In one example, the notification may be a pop up alert. The alert and resulting notification may contain information about the hearing aid profile including recommended environments for which the new hearing aid profile is suited. The user may then choose to download the hearing aid profile using input interface 146.

If the user decides to download the hearing aid profile, processor 142 receives the user input from user interface 144, generates a download request, and sends the download request to profile generating system 160. In response thereto, profile generating system 160 provides the hearing aid profile to computing device 130. Thus, computing device 130 is able to retrieve the hearing aid profile from profile generating system 160.

Once the hearing aid profile is downloaded and stored in memory 132, the user may access user interface 144 of computing device 130 to activate the downloaded hearing aid profile. Processor 142 receives a command to replace the hearing aid profile and executes hearing aid profile replacement instructions 140, which cause processor 142 to transmits the hearing aid profile to transceiver 122 of hearing aid 110. Processor 116 of hearing aid 110 then replaces hearing aid profile 114 with the hearing aid profile in memory 112. Once the replacement is complete, processor 116 uses the hearing aid profile to modulate an audio signal received from microphone 118 to generate a modulated audio signal. Processor 116 then provides the modulated audio signal to speaker 122, which reproduces the modulated audio signal as sound for the user.

Figure 2:
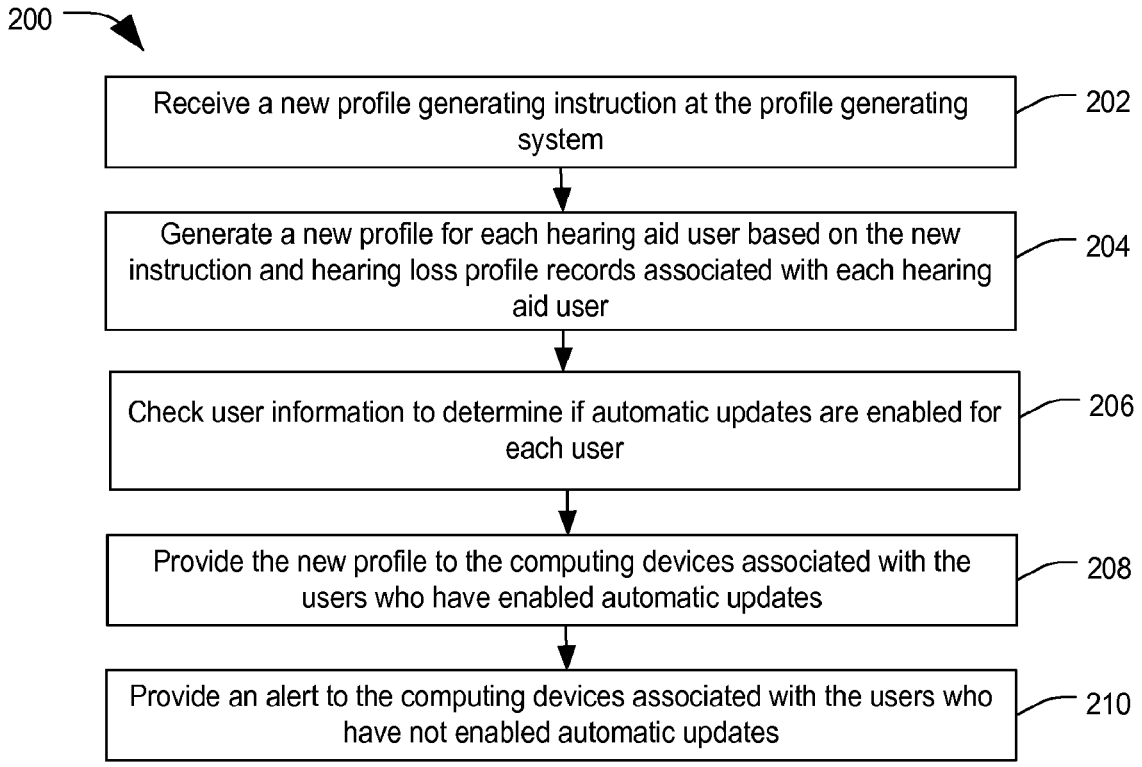
FIG. 2 is a flow diagram of an embodiment of a method of providing automated hearing aid profile updates.
Figure 3:
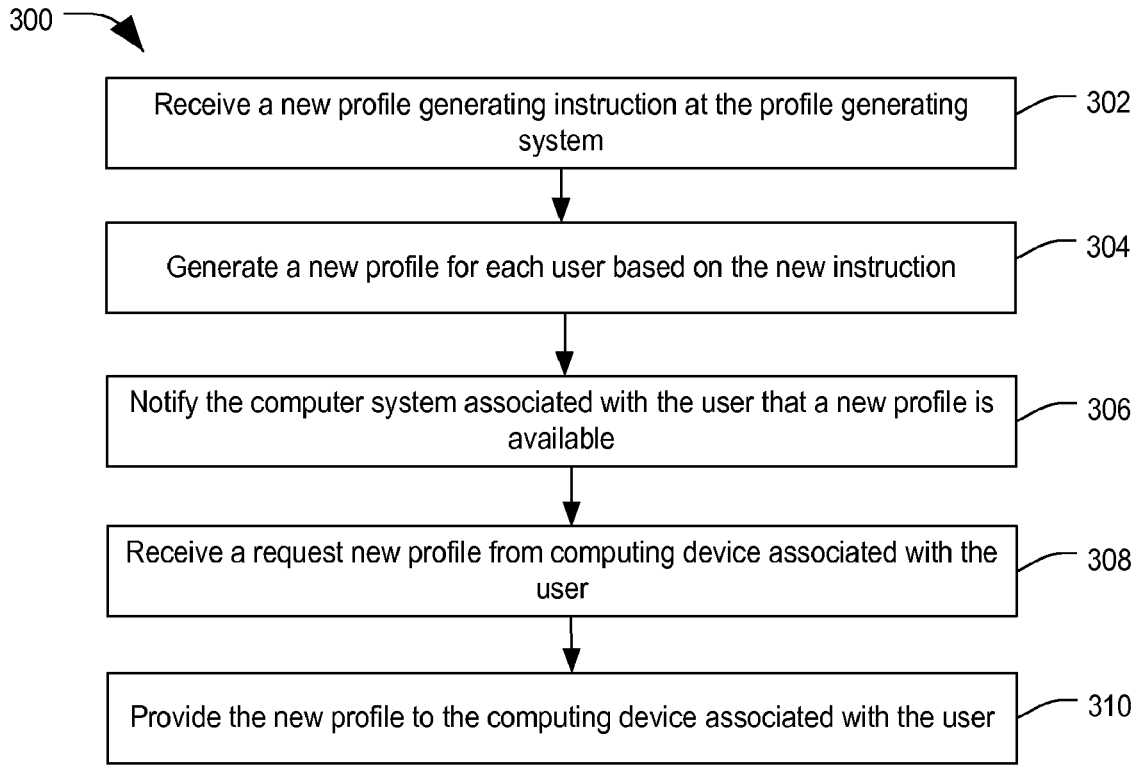
FIG. 3 is a flow diagram of an embodiment of a second method of providing automated hearing aid profile updates.
Figure 4:
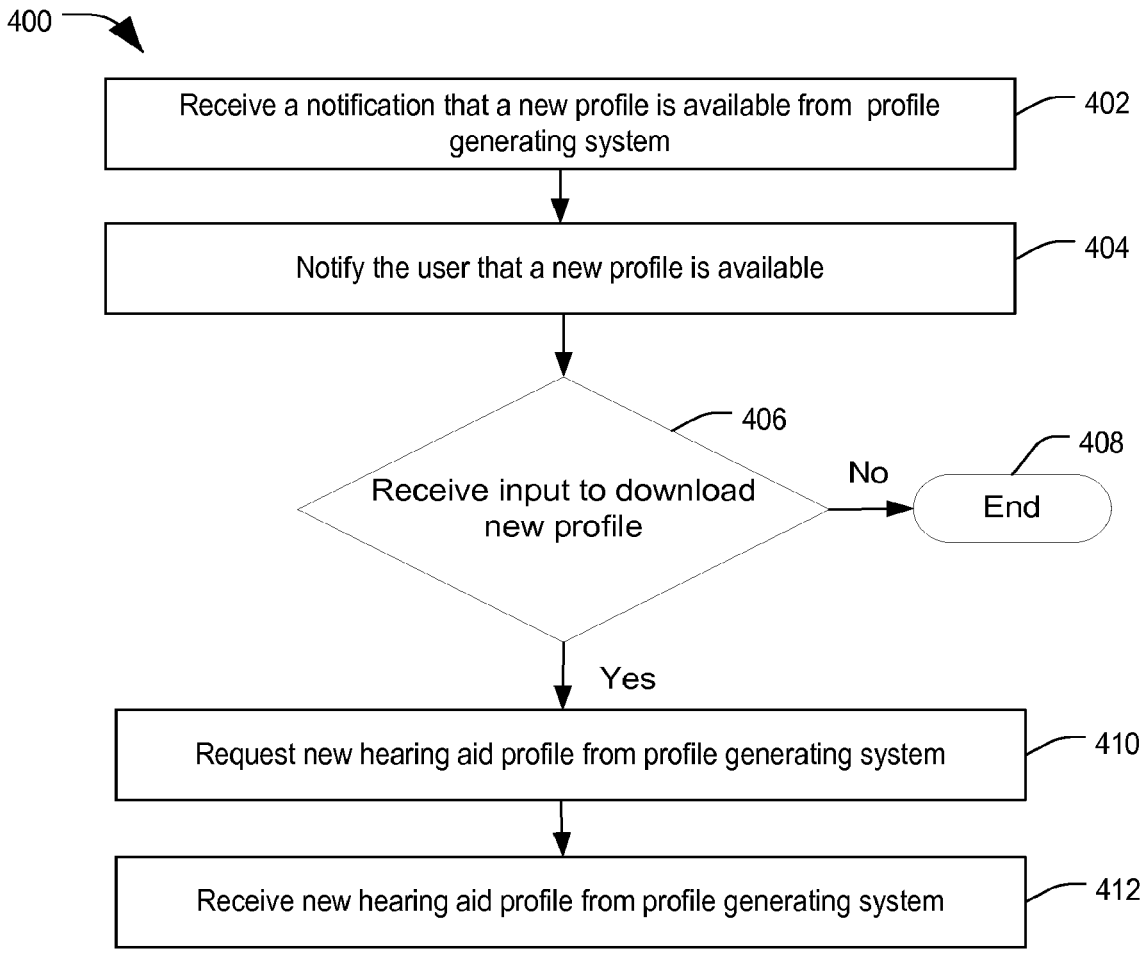
FIG. 4 is flow diagram of an embodiment of a method of receiving an automated hearing aid profile update at a user's computing device.

In general, the hearing aid profile can be updated thorough various methods, such as an automatic update pushed from profile generating system 160 to computing device 130. FIGS. 2-4 show several methods for providing automated hearing aid profile updates.

FIG. 2 is a flow diagram of an embodiment of a method 200 of providing automated hearing aid profile updates. At 202, profile generating system 160 receives a new profile generating instruction. Advancing to 204, profile generating system 160 generates a new hearing aid profile for each hearing aid user based on the new instruction and hearing loss profile records associated with each hearing aid user. Proceeding to 206, profile generating system 160 check the user information to determine if automatic updates are enabled for each user. Advancing to 208, profile generating system 160 provides the new hearing aid profile to the computing devices associated with users who have enabled automatic updates. Proceeding to 210, profile generating system 160 provides alerts to the computing devices associated with the users who have not enabled automatic updates to inform the users that a new hearing aid profile is available for download.

FIG. 3 provides a second method for providing the hearing aid profile updates, including a pull generated at computing device 130 to profile generating system 160.

FIG. 3 is a flow diagram of an embodiment of a second method 300 of providing automated hearing aid profile updates. At 302, profile generating system 160 receives a new hearing aid profile generating instruction in memory 162. Profile generating system 160 may detect the addition of the new hearing aid profile generating instruction or may receive a command to check the plurality of hearing aid profile generating instructions 172 for the new hearing aid profile generating instructions. Proceeding to 304, profile generating system 160 generates a new hearing aid profile for each hearing aid user by applying the new hearing aid profile generating instruction to a hearing loss profile associated with each hearing aid user stored in user information 164. Advancing to 306, profile generating system 160 notifies each computing device, such as computing device 130, associated with each entry in user information 164 that a new profile is available for the hearing aid user. Proceeding to 308, profile generating system 160 receives a request to download the new hearing aid profile from computing device 130 and advances to 310. At 310, profile generating system 160 provides the new hearing aid profile to computing device 130.

In general, the hearing aid profile is provided to computing device 130 for activation by the user. FIGS. 2-4 show several methods for providing automated hearing aid profile updates at hearing profile generating system 160, however, FIG. 4 is a flow diagram of an embodiment of a method of receiving an automated hearing aid profile update at a computing device 130.

FIG. 4 is flow diagram of an embodiment of a method 400 of receiving an automated hearing aid profile update at a user's computing device 130. At 402, computing device 130 receives a notification that a new profile is available from profile generating system 160. Advancing to 404, computing device 130 notifies the user that a new profile is available. Computing device 130 may notify the user by playing a tone or melody, vibrating, or providing a visual indication on display interface 148. Proceeding to 406, computing device 130 either receives an input to either download the new hearing aid profile from profile generating system 160 or to ignore the notification. If computing device 130 receives the input to ignore the notification, method 400 proceeds to 408 and method 400 ends. If, however, computing device 130 receives the input to download the new hearing aid profile, method 400 proceeds to 410 and computing device 130 sends a request for the new hearing aid profile to profile generating system 160. Advancing to 412, computing device 130, in response to sending the request, receives the new hearing aid profile from profile generating system 160 and method 400 ends. In one instance, computing device 130 may execute hearing aid profile replacement instructions 140 to active the new hearing aid profile on hearing aid 110. In another instance, computing device 130 may add the new hearing aid profile to the polarity of hearing aid profiles 136 and wait for the user to activate hearing aid profile replacement instructions 140 to activate the new hearing aid profile on hearing aid 110. In one instance, computing device 130 may prompt the user to name the new hearing aid profile using user interface 144 before storing the new hearing aid profile in memory 132.

Embodiments of systems and methods for providing automated hearing aid profile updates to hearing aid 110 are disclosed. In one embodiment, profile generating system 160 pushes newly generated hearing aid profiles to computing device 130 in response to changes in hearing profile generating instructions 172. In another embodiment, profile generating system 160 provides an alert to computing device 130 that an update is available and waits for a response before providing the updates. In one aspect, profile generating system 160 waits to generate the update until it receives a request. In another aspect, profile generating system 160 generates the update and stores it with user information 164 until the request is received. In general a system is disclosed that allows the user to take advantage of advances in hearing health sciences without purchasing new hearing aids or visiting a hearing health professional's office.

Although the present invention has been described with reference to preferred embodiments, workers skilled in the art will recognize that changes may be made in form and detail without departing from the scope of the invention.

What is claimed is:

1. A method for updating a hearing profile, the method comprising:

receiving, at a computing device associated with a user, an indication that a new hearing profile is available for download from a hearing profile generating system;

receiving, at the computing device, a user input indicative of a command to download the new hearing profile;

sending, from the computing device, a request to download the new hearing profile to the hearing profile generating system, wherein the hearing profile generating system is configured to generate the new hearing profile based at least in part on use profile information specific to the user that is stored at the hearing profile generating system, and after receiving new hearing profile generating instruction; and receiving, at the computing device, the new hearing profile from the hearing profile generating system.

2. The method of claim 1, further comprising:

providing an alert, at the computing device, in response to receiving the indication that the new hearing profile is available for download.

3. The method of claim 2 wherein providing the alert includes displaying the alert on a display interface of the computing device.

4. The method of claim 2 wherein the alert includes information about the new hearing profile.

5. The method of claim 4 wherein the information about the new hearing profile includes recommended environments for which the new hearing profile is suited.

6. The method of claim 1 wherein the new hearing profile is based at least in part on an existing hearing loss profile of the user.

7. The method of claim 1, further comprising:

executing hear profile replacement instructions to activate the new hearing profile on a device worn in the ear of the user, wherein the new hearing profile is configured to modulate an audio signal received at the device.

8. The method of claim 7 wherein the user input is a first user input, and wherein the method further comprises:

receiving, at the computing device, a second user input indicative of a command to replace an existing hearing profile with the new hearing profile.

9. The method of claim 1 wherein the computing device is at least one of a smart phone or a tablet.

10. A mobile-computing system for updating a hearing profile, the mobile-computing system comprising:

a network interface configured to communicate with a hearing profile generating system via a network;

a processor coupled to the network interface;

an input interface coupled to the processor and configured to receive user input; and a memory storing computer-executable instructions that, when executed by the processor, cause the processor to receive, via the network, an indication that a new hearing profile is available for download from the hearing profile generating system;

receive, via the input interface, a user input indicative of a command to download the new hearing profile;

send, via the network, a request to download the new hearing profile to the hearing profile generating system, wherein the hearing profile generating system is configured to generate the new hearing aid profile based at least in part on user profile information specific to the user that is stored at the hearing profile generating system and after receiving a new hearing profile generating instruction; and receive, via the network, the new hearing profile from the hearing aid profile generating system.

11. The mobile-computing system of claim 10, further comprising:

a transceiver coupled to the processor and configured to communicate with a hearing aid associated with the user, wherein the instructions, when executed by the processor, further cause the processor to send the new hearing profile to the hearing aid.

12. The mobile-computing system of claim 11 wherein the transceiver is configured to communicate wirelessly with the hearing aid, wherein the user input is a first user input, and wherein the instructions, when executed by the processor, further cause the processor to receive a second user input indicative of a command to replace an existing hearing profile stored in the hearing aid with the new hearing profile; and send the new hearing profile to the hearing aid in response to the second user input.

13. The mobile-computing system of claim 10, further comprising:

a display interface for displaying information, wherein the instructions, when executed by the processor, further cause the processor to display an alert in response to receiving the indication that the new hearing profile is available for download.

14. The mobile-computing system of claim 13 wherein the display interface and the input interface comprise the same touch screen interface.

15. The mobile-computing system of claim 10 wherein the instructions, when executed by the processor, further cause the processor to store the new hearing profile in the memory.

16. The method of claim 7 wherein the user is a first user, wherein the new hearing profile that is available for download is one of a plurality of new hearing profiles generated by the hearing profile generating system, and wherein at least one of the plurality of new hearing profiles is for a second user associated with a device to be worn in the ear of the second user.

* * * * *